US009076413B2

(12) United States Patent
Krumwiede

(10) Patent No.: US 9,076,413 B2
(45) Date of Patent: Jul. 7, 2015

(54) PEDAL OPERATED CONFIGURABLE GUITAR CHORD PLAYER

(71) Applicant: Kevin L Krumwiede, Corte Madera, CA (US)

(72) Inventor: Kevin L Krumwiede, Corte Madera, CA (US)

( * ) Notice: Subject to any disclaimer, the term of this patent is extended or adjusted under 35 U.S.C. 154(b) by 0 days.

(21) Appl. No.: 14/499,582

(22) Filed: Sep. 29, 2014

(65) Prior Publication Data

US 2015/0090096 A1 Apr. 2, 2015

Related U.S. Application Data

(60) Provisional application No. 61/884,667, filed on Sep. 30, 2013.

(51) Int. Cl.
*G10D 3/00* (2006.01)
*G10D 3/16* (2006.01)
*G10H 1/32* (2006.01)

(52) U.S. Cl.
CPC .. *G10D 3/16* (2013.01); *G10H 1/32* (2013.01); *G10H 2220/165* (2013.01)

(58) Field of Classification Search
CPC ..... G10D 3/00; G10D 3/16; G10H 1/32
See application file for complete search history.

(56) References Cited

U.S. PATENT DOCUMENTS

| | | | | | |
|---|---|---|---|---|---|
| 545,963 | A | * | 9/1895 | Ling | 84/317 |
| 589,658 | A | * | 9/1897 | Kelman | 84/317 |
| 627,410 | A | * | 6/1899 | Graus | 84/317 |
| 745,557 | A | * | 12/1903 | Baker | 84/315 |
| 831,238 | A | * | 9/1906 | Panelli | 84/317 |
| 1,094,038 | A | * | 4/1914 | Weaver et al. | 84/317 |
| 1,120,091 | A | * | 12/1914 | Schmidt | 84/317 |
| 1,219,884 | A | * | 3/1917 | Thingstad | 84/317 |
| 1,374,388 | A | * | 4/1921 | Reed | 84/315 |
| 1,437,026 | A | * | 11/1922 | Spartivento | 84/317 |
| 1,635,542 | A | * | 7/1927 | Conner | 84/317 |
| 1,785,311 | A | * | 12/1930 | Johnson | 84/317 |
| 2,132,281 | A | * | 10/1938 | Adamson | 84/317 |
| 2,450,210 | A | * | 9/1948 | Sprague | 84/315 |
| 2,669,151 | A | * | 2/1954 | MacCaferri | 84/317 |
| 2,790,344 | A | * | 4/1957 | Brimhall | 84/317 |
| 2,798,398 | A | * | 7/1957 | Hayes | 84/317 |
| 3,154,994 | A | * | 11/1964 | Blohm | 84/317 |
| 3,422,717 | A | * | 1/1969 | Roussel | 84/317 |
| 3,439,571 | A | * | 4/1969 | Ryan | 84/312 R |
| 3,446,108 | A | * | 5/1969 | Mitchell, Jr. | 84/317 |
| 3,568,560 | A | * | 3/1971 | Chang et al. | 84/317 |
| 3,915,051 | A | * | 10/1975 | Kincaid | 84/317 |
| 3,995,523 | A | * | 12/1976 | Clarke | 84/317 |
| 4,030,400 | A | * | 6/1977 | Del Castillo | 84/317 |

(Continued)

*Primary Examiner* — Robert W Horn

(57) ABSTRACT

A pedal operated configurable guitar chord player is used in conjunction with a selection software and includes a chord actuator, an actuator assembly, and a pedal. The chord actuator provides a support structure, wherein the actuator assembly is positioned within a casing and connected to a base and a mounting frame. A first clamp and a second clamp attached to the base allow the chord actuator to be attached to the neck of a guitar, wherein a plurality of actuators of the actuator assembly is positioned overtop each of the guitar strings. The plurality of actuators is controlled by a microcontroller that is communicably coupled to an electronic device through an electronic device connection means. The pedal signals the microcontroller to progress the plurality of actuators to form the subsequent chords, wherein the order of chords is determined through the selection software.

20 Claims, 15 Drawing Sheets

(56) References Cited

U.S. PATENT DOCUMENTS

| | | | | | |
|---|---|---|---|---|---|
| 4,331,059 | A | * | 5/1982 | Marabotto | 84/317 |
| 4,545,282 | A | * | 10/1985 | Arnett et al. | 84/317 |
| 4,566,365 | A | * | 1/1986 | Huston, Jr. | 84/317 |
| 4,622,880 | A | * | 11/1986 | Glemming et al. | 84/317 |
| 4,665,789 | A | * | 5/1987 | Papadatos | 84/317 |
| 5,831,189 | A | * | 11/1998 | Edlund | 84/315 |
| 6,753,466 | B1 | * | 6/2004 | Lee | 84/669 |
| 7,812,233 | B1 | * | 10/2010 | Lee | 84/317 |
| D669,117 | S | * | 10/2012 | de Neufville | D17/20 |
| 8,319,082 | B1 | * | 11/2012 | Bacon | 84/314 R |
| 8,835,731 | B1 | * | 9/2014 | Perry | 84/317 |
| 2015/0090096 | A1 | * | 4/2015 | Krumwiede | 84/317 |

* cited by examiner

Load default songs
New song
Edit
Sim Pedal
Stop
Greensleeves

Greensleeves traditional

Em G D Em
Alas, my love, you do me wrong,
Em B7
To cast me off discourteously.
Em G D B7
For I have loved you well and long,
Em B7 Em
Delighting in your company.

G D
Greensleeves was all my joy
Em B7
Greensleeves was my delight,
G D
Greensleeves was my heart of gold,
Em B7 E
And who but my lady greensleeves.

FIG. 15

PEDAL OPERATED CONFIGURABLE GUITAR CHORD PLAYER

The current application claims a priority to the U.S. Provisional Patent application Ser. No. 61/884,667 filed on Sep. 30, 2013.

FIELD OF THE INVENTION

The present invention relates generally to assisted guitar players. More specifically, the present invention is a portable apparatus that can temporarily attach to a guitar and enable electronic actuation of chords through the press of a button or foot pedal in conjunction with a software interface.

BACKGROUND OF THE INVENTION

The guitar is one of the most popular musical instruments used in performances throughout the entire world. According to the 2012 Music Trades Music Industry Census Report, Fretted Instruments and Related Products is a $1.5 billion industry with 1 million-1.5 million acoustic guitars sold every year. A vast majority of those guitars are entry level guitars below $500 indicating a very regular interest for new learners.

Unfortunately, many of the consumers that purchase guitars never reach an advanced level of proficiency, likely due to the steep learning curve and ongoing time demands of practice. Concurrently, many proficient players lose the ability to play at some point due to physical ailments or disabilities that inhibit the individual's physical dexterity required to play. There are many examples of lifelong players that lost the ability to play because of hand/arm/shoulder injury, stroke or arthritis. Likewise, many people born with an ailment impacting one of their hands may have never had the opportunity to learn a musical instrument.

Attempts have been made to bring automation to guitars in order to overcome the limitations of some users. However, such devices fall short in many areas. For one, most automated guitar devices are not designed to be portable, often requiring elaborate setups to properly align and mount to the guitar. Still, other devices are designed as permanent fixtures further diminishing the portability of the instrument. Another issue is the amount of control over the instrument that is provided to the user. Most of these devices feature chords that are sequentially actuated automatically, while others are fully automated, providing picking mechanisms, thus leaving no control to the user at all.

The emergence of computer technology and musical software interfaces has revolutionized the options for musicians. With the combination of newly developed software and hardware, guitar players now have opportunities they may not have had, with higher forms of versatility and musical capacity compared to previous history.

Therefore it is the object of the present invention to provide a pedal operated configurable guitar chord player. The present invention is a portable apparatus that will temporarily attach to a guitar enabling electronic actuation of chords on the fret board using a single foot pedal or a single push button, which when pushed will actuate the next chord in a sequence of pre-programmed chords. The present invention allows the user to play any standard guitar using one hand to pick or strum while one foot or one finger presses the pedal or button to actuate the chords. The apparatus leverages software that interfaces to the apparatus from a computer or mobile device to define chords, the sequence in which they should be played, and if applicable, the lyrics. Chords and lyrics are highlighted in the software as the applicable chord becomes active on the device. The present invention is a suited for use among new learners, children, disabled persons, and seasoned guitarists.

BRIEF DESCRIPTION OF THE DRAWINGS

FIG. 15 is an exemplary screenshot of a song selection page, wherein the user can select existing songs or create new songs.

DETAIL DESCRIPTIONS OF THE INVENTION

All illustrations of the drawings are for the purpose of describing selected versions of the present invention and are not intended to limit the scope of the present invention.

Figure 1:
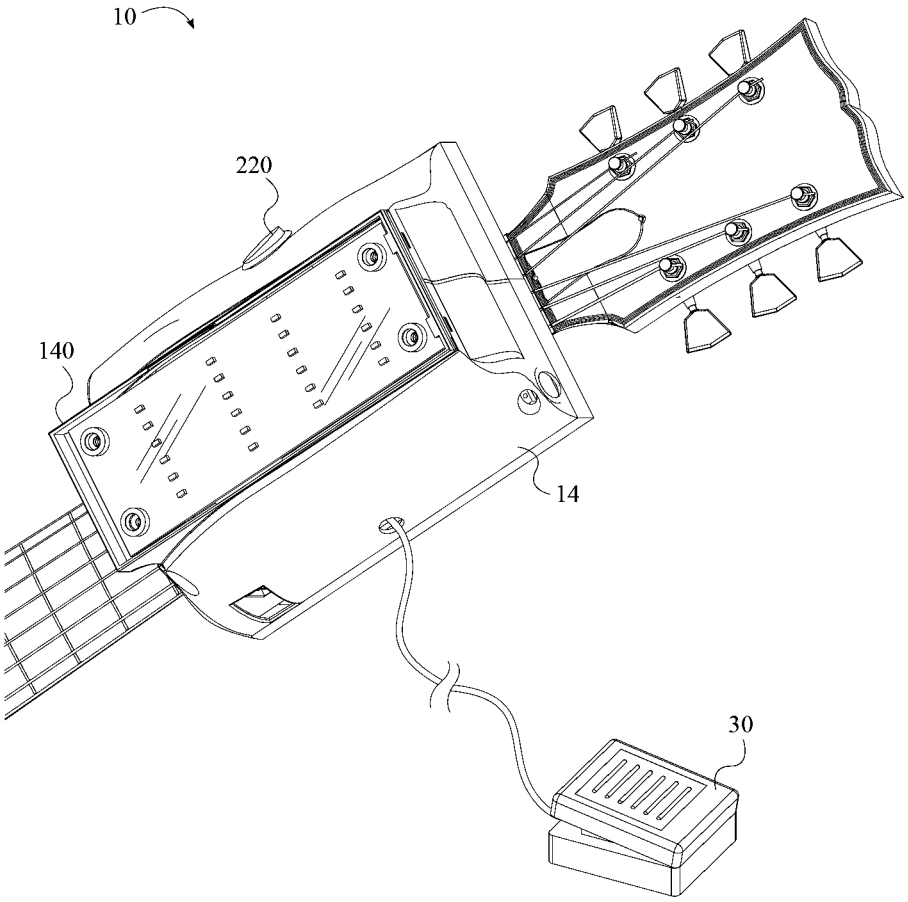
FIG. 1 is a front perspective view of the present invention, wherein the chord actuator is attached to the neck of a guitar.
Figure 2:
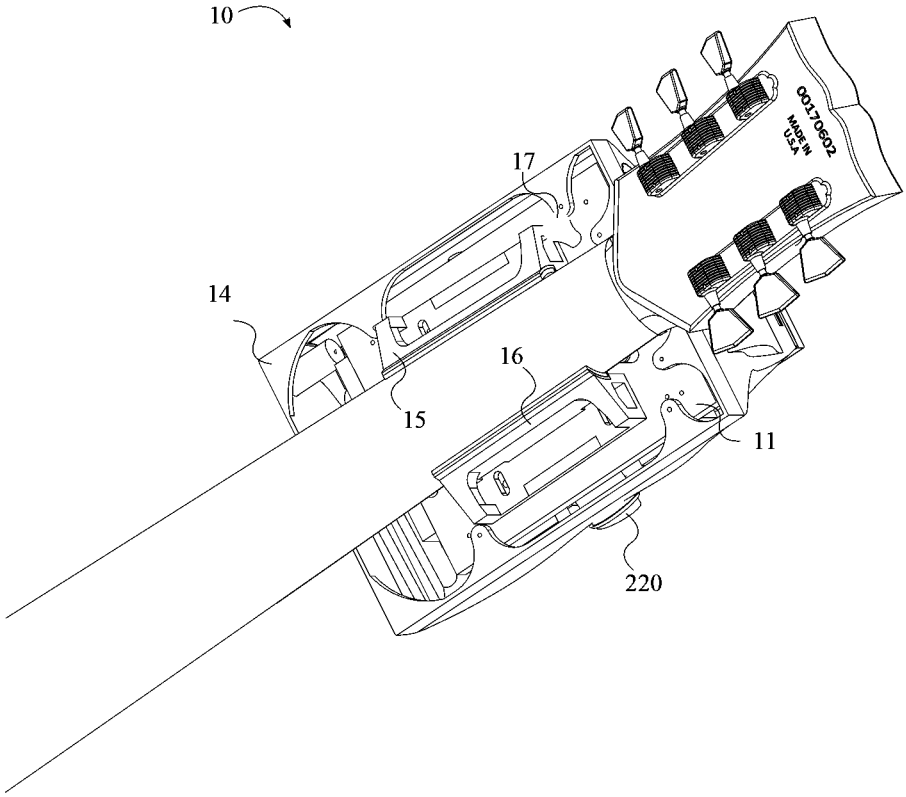
FIG. 2 is a rear perspective of the chord actuator attached to the neck of the guitar.

The present invention is a pedal operated configurable guitar chord player that is used to assist an individual in playing a guitar. The present invention is utilized in conjunction with a selection software and comprises a chord actuator 10, an actuator assembly 20, and a pedal 30. The chord actuator 10 is secured to the neck of a guitar, as shown in FIGS. 1-2, and houses the actuator assembly 20. The actuator assembly 20 is communicably connected to the selection software, wherein the selection software dictates the chords to be played to the actuator assembly 20. Additionally, the pedal 30 is operably connected to the actuator assembly 20 and allows the user to sequentially progress through selected chords.

Figure 3:
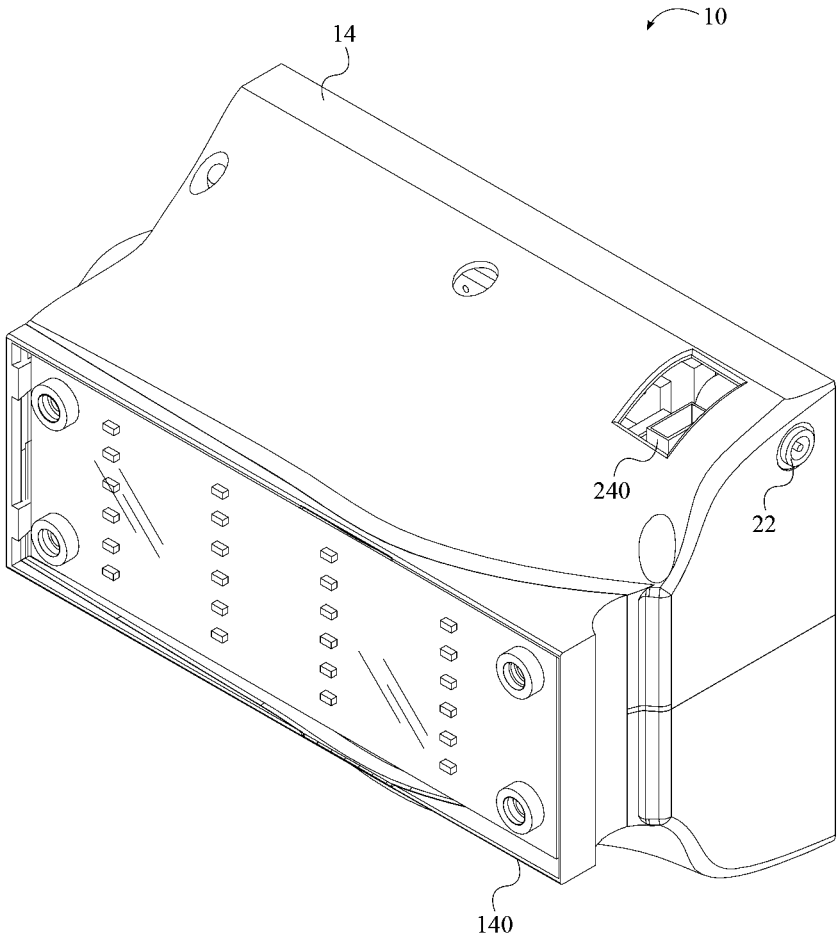
FIG. 3 is a front perspective view of the chord actuator, displaying the transparent panel of the casing.
Figure 4:
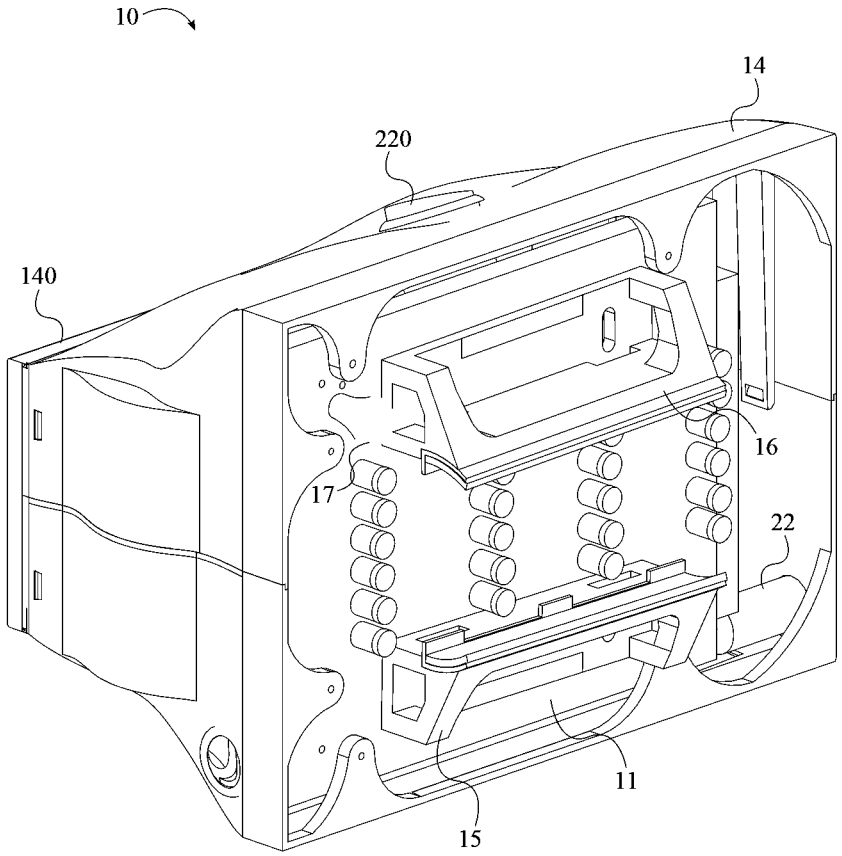
FIG. 4 is a rear perspective view of the chord actuator.
Figure 5:
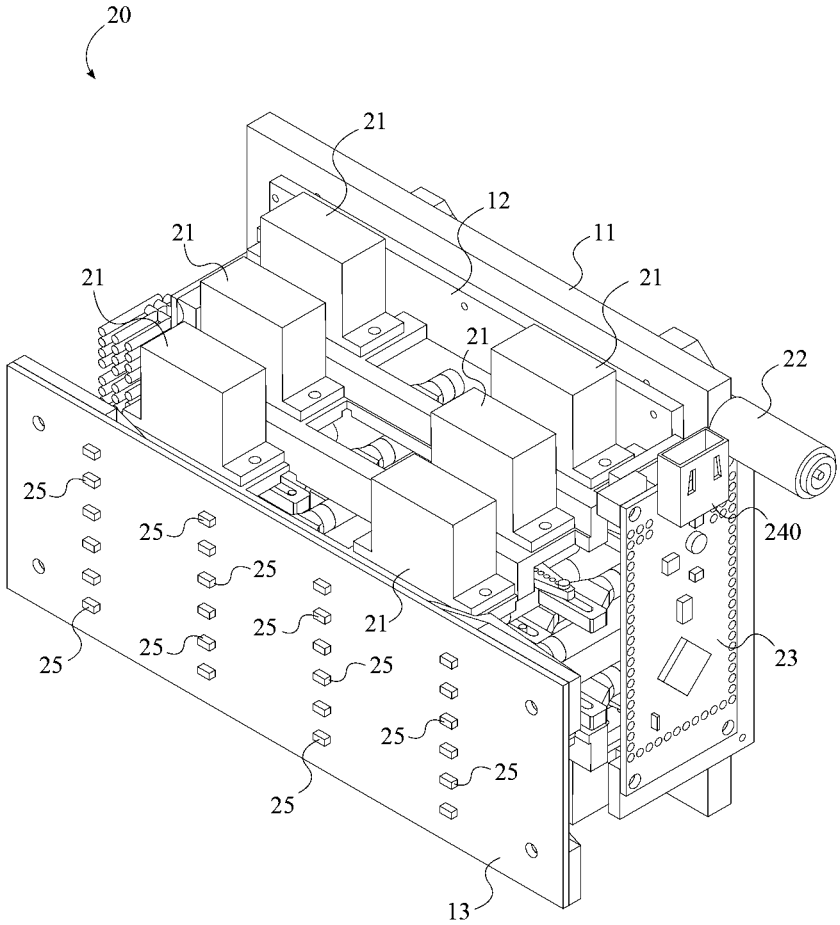
FIG. 5 is a front perspective view of the chord actuator with the casing removed, wherein the actuator assembly is visible.

In reference to FIGS. 3-5, the chord actuator 10 comprises a base 11, a mounting frame 12, a chord actuator board, a casing 14, a first clamp 15, a second clamp 16, and a guitar strap attachment 17. The mounting frame 12 is adjacently connected to the base 11, and the chord actuator board is connected to the mounting frame 12 opposite the base 11. Together, the base 11, the mounting frame 12, and the chord actuator board provide the supporting structure for mounting the actuator assembly 20. The casing 14 is adjacently attached to the base 11 and is positioned around the mounting frame 12 and the chord actuator board, wherein the casing 14 can be removed in order to access the actuator assembly 20 for any necessary maintenance.

In reference to FIG. 2, the first clamp 15 and the second clamp 16 provide a means for attaching the chord actuator 10 to the neck of the guitar. The first clamp 15 and the second clamp 16 are attached to the base 11 opposite the mounting frame 12; the first clamp 15 and the second clamp 16 being positioned opposite each other across the base 11. In the preferred embodiment of the present invention, the first clamp 15 and the second clamp 16 are attached to the base 11 by a plurality of screws, wherein the distance between the first clamp 15 and the second clamp 16 can be varied, thus allowing the chord actuator 10 to be fitted onto any sized guitar neck.

Figure 6:
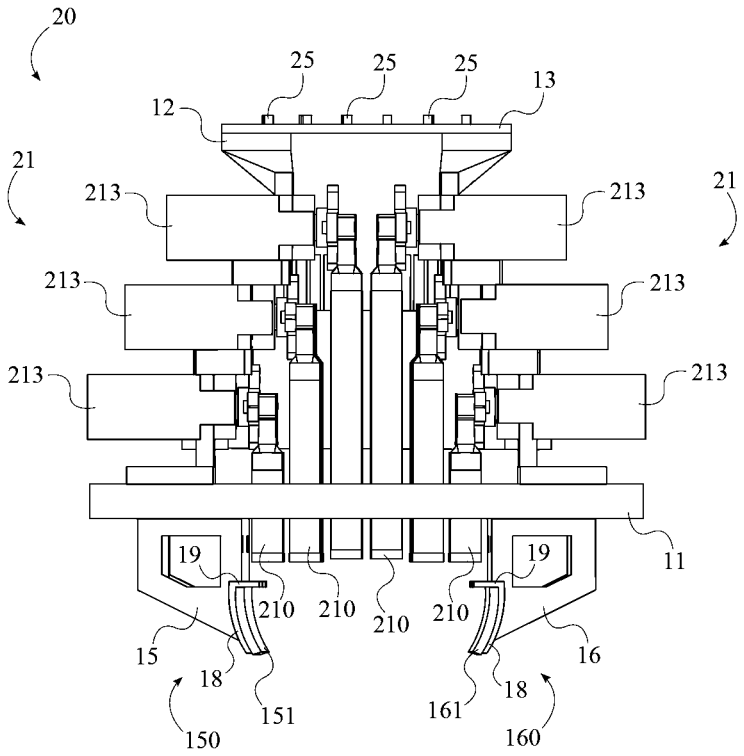
FIG. 6 is a right side sectional view of the actuator assembly and the chord actuator, wherein the casing is removed.

In reference to FIG. 6, the first clamp 15 comprises a first flange 150 and a first grip 151; the first flange 150 having a curved portion 18 and a flat portion 19. The curved portion 18 of the first flange 150 is contoured to mimic the curve of the side of a guitar neck, while the flat portion 19 of the first flange 150 extends from the curved portion 18 and rests on top of the neck of the guitar. A plurality of notches is cut into the flat portion 19 of the first flange 150, such that the flat portion 19 of the first flange 150 is spaced around the frets of the guitar. The first grip 151 is adjacently connected to the first flange 150; more specifically, the curved portion 18 of the first flange 150.

The first grip 151 provides increased friction between the first clamp 15 and the guitar neck, such that the chord actuator 10 does not slide along the guitar neck.

Additionally, the first grip 151 protects the finish of the guitar while the chord actuator 10 is attached to the guitar. In the preferred embodiment of the present invention, the first grip 151 is constructed from a rubberized material, however, it is possible for the first grip 151 to be constructed from any other material capable of protecting the guitar and providing increased friction.

In reference to FIG. 6, the second clamp 16 comprises a second flange 160 and a second grip 161; the second flange 160 having a curved portion 18 and a flat portion 19. The curved portion 18 of the second clamp 16 is contoured to mimic the curve of the side of a guitar neck, while the flat portion 19 of the second flange 160 extends from the curved portion 18 of the second flange 160 and rests on top of the neck of the guitar. A plurality of notches is cut into the flat portion 19 of the second flange 160, such that the flat portion 19 of the second flange 160 is spaced around the frets of the guitar. The second grip 161 is adjacently connected to the second flange 160; more specifically, the curved portion 18 of the second flange 160.

The second grip 161 provides increased friction between the second clamp 16 and the guitar neck, such that the chord actuator 10 does not slide along the guitar neck. Additionally, the second grip 161 protects the finish of the guitar while the chord actuator 10 is attached to the guitar. In the preferred embodiment of the present invention, the second grip 161 is constructed from a rubberized material, however, it is possible for the second grip 161 to be constructed from any other material capable of protecting the guitar and providing increased friction.

In reference to FIG. 2, the guitar strap attachment 17 provides a means for attaching a guitar strap to the chord actuator 10, such that the user can stand while playing the guitar and using the present invention. Similar to the first clamp 15 and the second clamp 16, the guitar strap attachment 17 is adjacently connected to the base 11 opposite the mounting frame 12. In the preferred embodiment, the guitar strap attachment 17 is in the form of the traditional knob found on guitars, however, the guitar strap attachment 17 can be formed in any other suitable manner.

Figure 11:
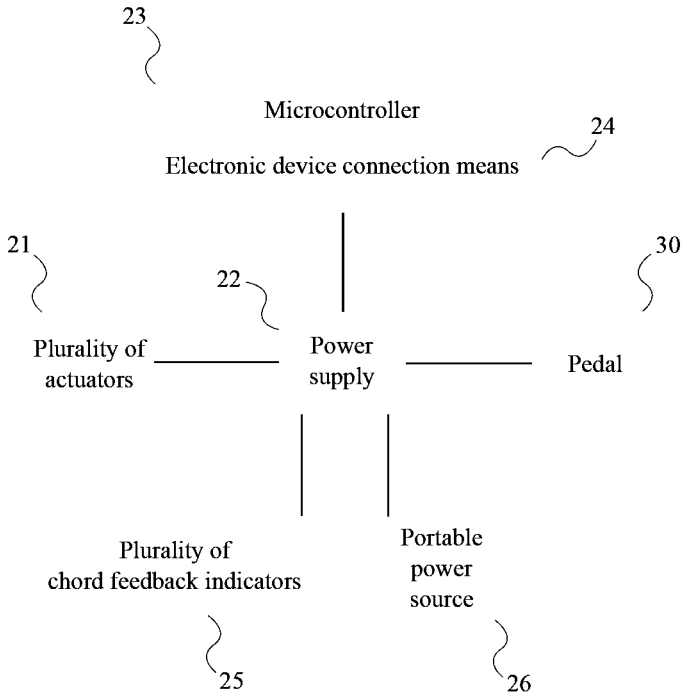
FIG. 11 is a diagram depicting the electrical connections of the actuator assembly.

In reference to FIG. 5, the actuator assembly 20 is positioned within the casing 14 and comprises a plurality of actuators 21, a microcontroller 23, a power supply 22, an electronic device connection means 24, and a plurality of chord feedback indicators 25. The power supply 22 is adjacently connected to the base 11 and diverts electrical energy received from a power source to the other components of the actuator assembly 20. As such, the plurality of actuators 21, the microcontroller 23, the electronic device connection means 24, and the plurality of chord feedback indicators 25 are electrically connected to the power supply 22, as depicted in FIG. 11. The power supply 22 comprises a power switch 220 that is positioned through the casing 14, such that the user can toggle the power supply 22 on and off.

In reference to FIG. 6, each of the plurality of actuators 21 is adjacently connected to the mounting frame 12 and comprises at least one finger 210. The at least one finger 210 of each of the plurality of actuators 21 is an elongated member that traverses through the base 11 and can be positioned in a neutral position and an actuated position. In the actuated position, the at least on finger is depressed into a guitar string about a fret, such that the musical note corresponding to the fret is played when the guitar string is plucked, strummed, etc. In the neutral position, the at least one finger 210 rests above the guitar string such that the musical note corresponding to the open guitar string can be played.

Figure 7:
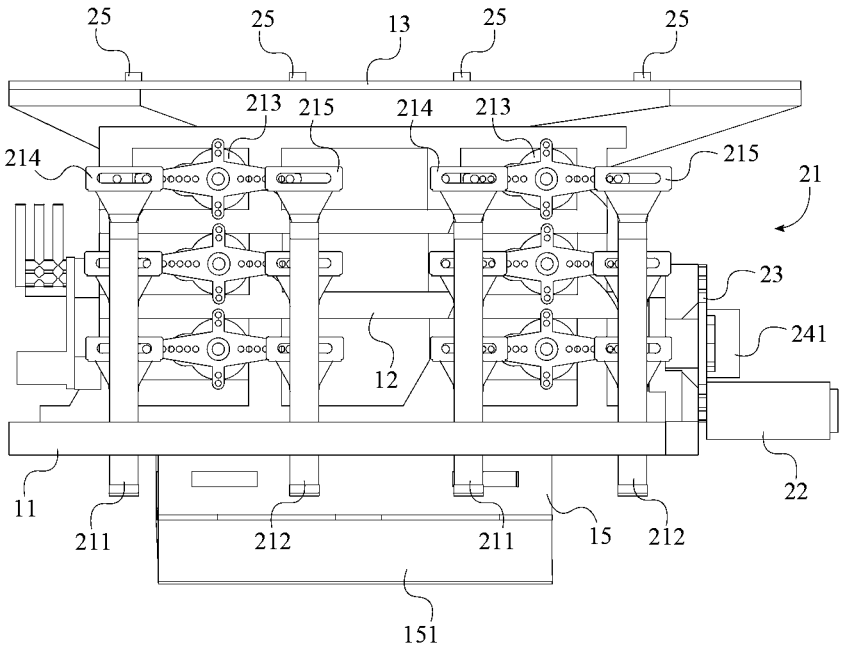
FIG. 7 is a bottom section view of the actuator assembly and the chord actuator, wherein the casing is removed and the electronic device connection means is an actuator transceiver.
Figure 8:
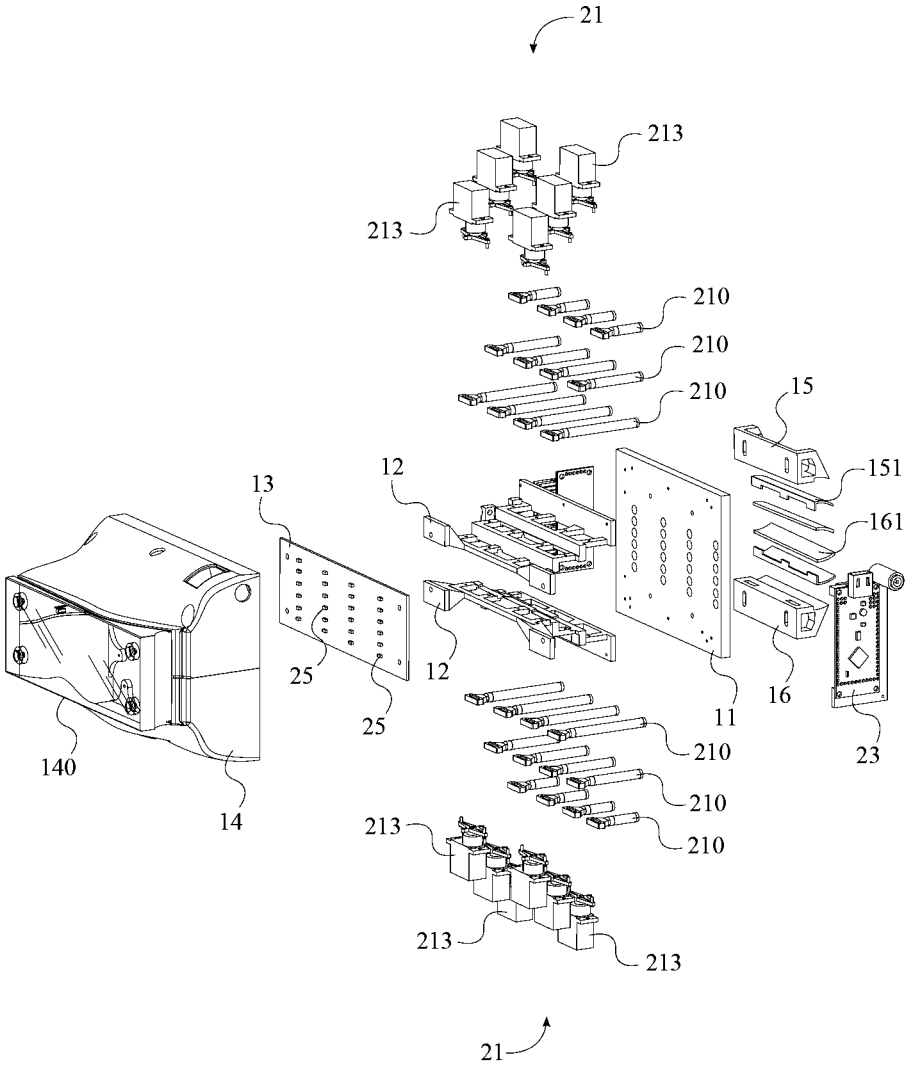
FIG. 8 is an exploded view of the present invention.

In reference to FIG. 7, in the preferred embodiment of the present invention, each of the plurality of actuators 21 comprises a servo 213, a first teeter joiner 214, and a second teeter joiner 215. Additionally, the at least one finger 210 is specifically a first finger 211 and a second finger 212. The first teeter joiner 214 and the second teeter joiner 215 are both pivotally connected to the servo 213; the first teeter joiner 214 and the second teeter joiner 215 being positioned opposite each other about the servo 213. The first finger 211 is adjacently connected to the first teeter joiner 214 and the second finger 212 is adjacently connected to the second teeter joiner 215.

In reference to FIGS. 6-7, the servo 213 of each of the plurality of actuators 21 is adjacently connected to the mounting frame 12, wherein two servos are positioned above each guitar string, such that four fingers are available to play four notes along each guitar string. Rotation of the servo 213 in a first direction causes the first teeter joiner 214 and the second teeter joiner 215 to pivot, wherein the first finger 211 is depressed into the guitar string while the second finger 212 is lifted away from the guitar string. Conversely, rotation of the servo 213 in a second direction opposite the first direction causes the first teeter joiner 214 and the second teeter joiner 215 to pivot, wherein the second finger 212 is depressed into the guitar string while the first finger 211 is lifted away from the guitar string.

In an alternative embodiment of the present invention, each of the plurality of actuators 21 is a linear actuator, wherein the at least one finger 210 is specifically one finger. Each of the plurality of actuators 21 is aligned along a string of the guitar and about a fret, such that each of the plurality of actuators 21 corresponds to a different musical note. In this way, the one finger of each of the plurality of actuators 21 is depressed straight into the guitar string to produce the desired musical note. The use of a linear actuator for each of the plurality of actuators 21 would allow for a more compact design of the present invention.

In reference to FIG. 5, the plurality of chord feedback indicators 25 is positioned about the chord actuator board, wherein each of the plurality of chord feedback indicators 25 corresponds to a note on the guitar. In the preferred embodiment of the present invention, each of the plurality of chord feedback indicators 25 is a light emitting diode, however, it is possible for any other type of light source to be used. As the plurality of actuators 21 is operated to form chords, the plurality of chord feedback indicators 25 light up in accordance to the at least one finger 210 of each of the plurality of actuators 21 that is currently depressed.

In reference to FIG. 2, the casing 14 comprises a transparent panel 140. The transparent panel 140 is positioned about the chord actuator board, wherein the transparent panel 140 is positioned adjacent to the plurality of chord feedback indicators 25, such that the user can readily view the plurality of chord feedback indicators 25 as each of the plurality of chord feedback indicators 25 is illuminated.

Figure 12:
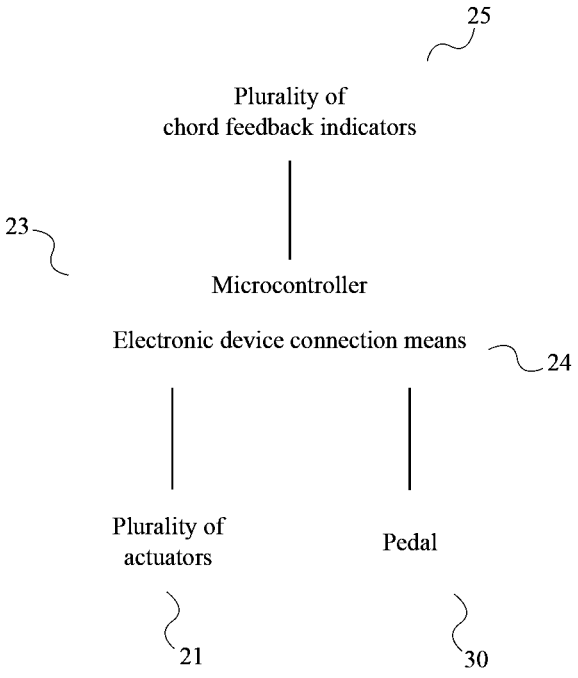
FIG. 12 is a diagram depicting the electronic connections of the actuator assembly.

The microcontroller 23 dictates which of the plurality of actuators 21 is to be activated (and in which direction the servo 213 should rotate if servos are to be used), and the corresponding plurality of chord feedback indicators 25 to illuminate. As such, both the plurality of actuators 21 and the plurality of chord feedback indicators 25 are electronically connected to the microcontroller 23, as depicted in FIG. 12. Additionally, the electronic device connection means 24 is electronically connected to the microcontroller 23, again as depicted in FIG. 12, and is the device by which the microcontroller 23 receives programmed instructions for dictating the desired chords to be played.

Figure 9:
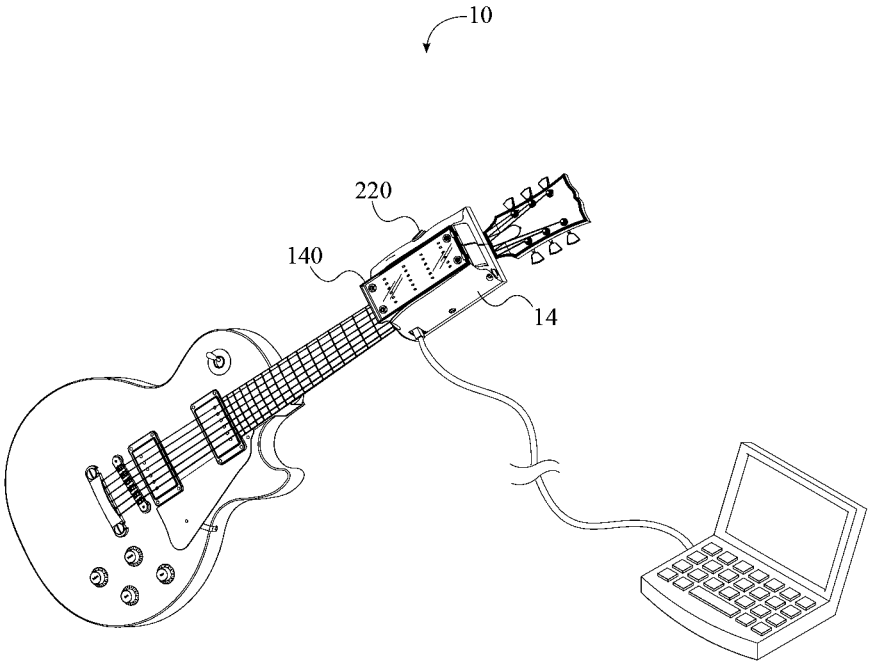
FIG. 9 is a diagram depicting the actuator assembly being communicably connected to an electronic device through a wired connection, wherein the electronic device connection means is a port.

In the preferred embodiment of the present invention, the electronic device connection means 24 is a port 240. The port 240 is connected to either the base 11 or the casing 14 and traverses through the casing 14, such that it is accessible to the user. In reference to FIG. 9, one end of a cable is plugged into the port 240 and the other end of the cable is plugged into an electronic device such as a computer, tablet, smartphone, etc. The selection software is operated on the electronic device and allows the user to select the chords to be imported to the microcontroller 23 based on song selection, desired chords, etc.

Figure 10:
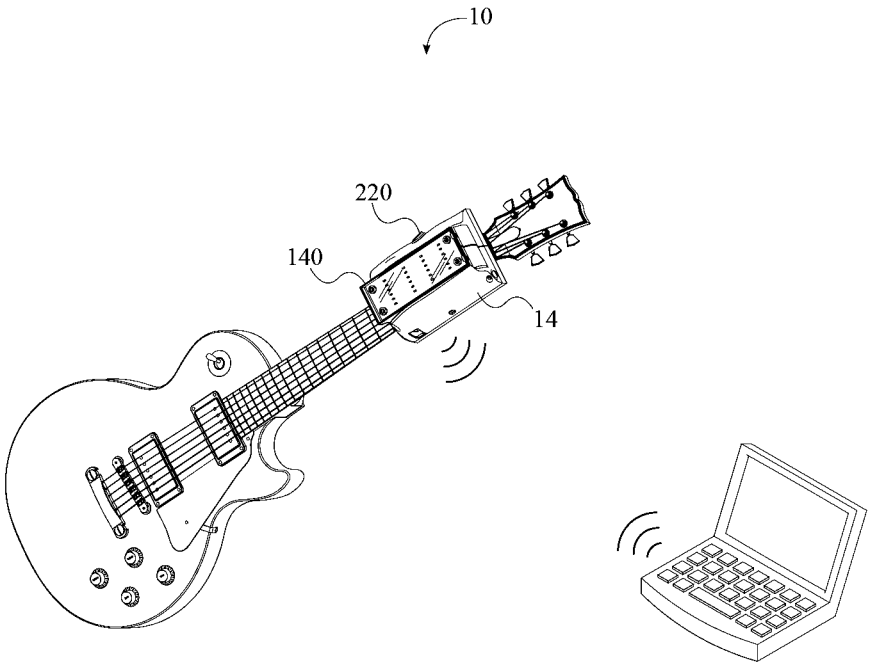
FIG. 10 is a diagram depicting the actuator assembly being communicably connected to an electronic device through a wireless connection, wherein the electronic device connection means is an actuator transceiver.

In an alternative embodiment of the present invention, the electronic device connection means 24 is a actuator transceiver 241. The actuator transceiver 241 is connected to either the base 11 or the casing 14 and is positioned within the casing 14. In reference to FIG. 10, the actuator transceiver 241 is communicably coupled to a device transceiver in an electronic device such as a computer, tablet, smartphone, etc. Chords selected through the selection software are then wirelessly transmitted from the electronic device to the microcontroller 23 via the actuator transceiver 241 and device transceiver.

In reference to FIG. 11, the actuator assembly 20 may further comprise a portable power source 26, such as a battery. The portable power source 26 is positioned within the casing 14 and may be rechargeable or replaceable. If the portable power source 26 is rechargeable, then the portable power source 26 may comprise a charge port 240 for recharging the portable power source 26. Alternatively, the portable power source 26 may be designed for wireless charging. If the portable power source 26 is replaceable, then the casing 14 may comprise an access panel that is removable in order to provide quick access to the portable power source 26.

In reference to FIG. 1 and FIGS. 11-12, the pedal 30 is also electronically connected to the microcontroller 23 and electrically connected to the power supply 22, wherein the pedal 30 is wired to the actuator assembly 20. The pedal 30 provides a type of switch for transitioning from one chord to a subsequent chord. When the pedal 30 is pressed, an electronic signal is sent to the microcontroller 23. Upon receiving the electronic signal, the microcontroller 23 determines which of the plurality of actuators 21 to actuate and which of the plurality of actuators 21 to deactivate, such that the at least one finger 210 of each of the plurality of actuators 21 is properly positioned as to produce the desired chord when the guitar is played.

Figure 13:
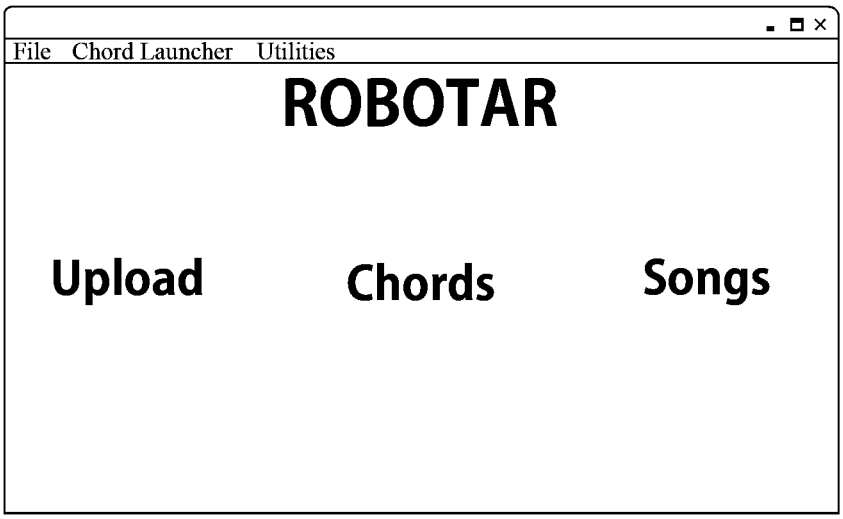
FIG. 13 is an exemplary screenshot of the selection software.

In reference to FIG. 13, the present invention is operated in conjunction with a selection software in order to dictate chords to be played on a guitar. The selection software is operated on an electronic device, such as a computer, tablet, or smartphone, and provides the user with an interface for selecting chords, songs, etc. The selection software may be run as an individual program or may be accessed on a website through a web browser. The selection software provides two main methods of selecting which chords should be dictated by the microcontroller 23, which are described as follows.

Figure 14:
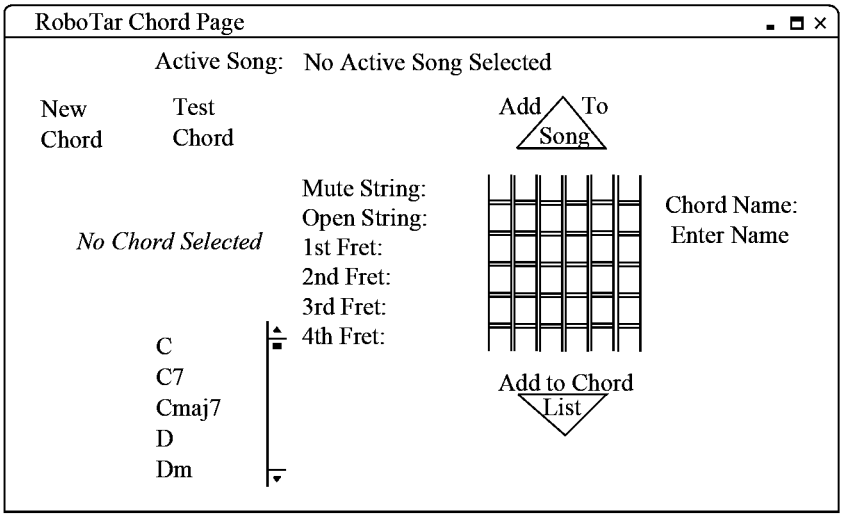
FIG. 14 is an exemplary screenshot of a chord selection page, wherein a user can select existing chords or create new chords.

In reference to FIG. 14, one method in which a user can select chords, is by directly selecting specific chords through the selection software. A default list of chords is provided through the selection software, wherein the user can select the specific chords that he or she would like to play. The user may be able to select multiple chords and the order in which they are queued on the microcontroller 23. As chords are played, they are displayed on the electronic device through the selection software. Additionally, the selection software allows the user to create his or her own unique chords through a chord creation tool. Created chords can be saved to the default list of chords or in a separate chords list.

In reference to FIG. 15, the other method in which a user can select chords, is by selecting a song through the selection software. A songs page is provided through the selection software, wherein the user can select the song that he or she would like to play. Once the user has selected a desired song, the chords for the desired song are retrieved by the selection software and are queued on the microcontroller 23. Additionally, if lyrics are available for the desired song, then the lyrics are retrieved along with the chords, wherein the lyrics and chords are displayed together through the selection software as the user plays the guitar.

The selection software allows the user to create his or her own unique songs through a song creation tool. Songs can be created using the default list of chords or user created chords. Similar to created chords, created songs can be saved to a default list of songs or in a separate songs list and accessed from the songs page. Additionally, the selection software allows the user to create lyrics, which can then be saved as part of the song. Songs can also be imported to the songs page from a central repository or from a website, wherein the web site may include a social sharing option or a set of pre-defined songs and chords.

In order to utilize the present invention, a desired song or chord(s) is first chosen by the user through the selection software. Once chosen, data for the chosen chord(s) or the chords associated with the song is retrieved by the selection software and transmitted to the microcontroller 23 through the electronic device connection means 24. The first chord can be initiated in one of two way; either automatically once the microcontroller 23 receives the chord data or once the pedal 30 has been pressed. Once the user is ready to progress to the subsequent chord, he or she simply presses the pedal 30, wherein the plurality of actuators 21 are manipulated by the microcontroller 23 to form the subsequent chord.

As the user plays the guitar using the present invention, the selection software displays the chord that is currently being actuated by the actuator assembly 20 in addition to any lyrics associated with the current chord. When the user presses the pedal 30 in order to change chords, the microcontroller 23 generates an electrical signal that is sent to the electronic device through the electronic device connection means 24. The electrical signal then informs the selection software to display the next chord and any accompanying lyrics.

The selection software additionally provides a calibration function for properly orienting the at least one finger 210 of each of the plurality of actuators 21. Using the calibration function, the proper height in the neutral position for avoiding contact with the guitar strings and the actuation distance can be set for the at least one finger 210 of each of the plurality of actuators 21. The actuated position for the at least one finger 210 of each of the plurality of actuators 21 can also be calibrated to allow for note muting, which is beneficial for beginner players who are learning which guitar strings to pluck in a chord.

It is also possible for the selection software to provide additional functions to supplement playing the guitar. One such function that the selection software may include is a metronome function, wherein audible and/or visible indication of the tempo is made available to the user through the electronic device. Another function that the selection software may include is a tuner function, wherein the selection software utilizes a microphone of the electronic device to capture the sound from the guitar and provide tuning feedback to the user.

Although the invention has been explained in relation to its preferred embodiment, it is to be understood that many other possible modifications and variations can be made without departing from the spirit and scope of the invention as hereinafter claimed.

What is claimed is:

1. A pedal operated automatic guitar chord player comprises:
- a chord actuator;
- an actuator assembly;
- a pedal;
- the chord actuator comprises a base, a mounting frame, a casing, a first clamp, and a second clamp;
- the actuator assembly comprises a plurality of actuators, a microcontroller, and a power supply;
- each of the plurality of actuators comprises at least one finger;
- the microcontroller comprises an electronic device connection means;
- the mounting frame being adjacently connected to the base;
- the casing being adjacently attached to the base;
- the casing being positioned around the mounting frame;
- the first clamp and the second clamp being adjacently attached to the base opposite the mounting frame;
- the first clamp and the second clamp being positioned opposite each other across the base;
- the actuator assembly being positioned within the casing;
- the plurality of actuators being adjacently connected to the mounting frame;
- the plurality of actuators, the microcontroller, and the pedal being electrically connected to the power supply;
- the plurality of actuators and the pedal being electronically connected to the microcontroller; and
- the at least one finger of each of the plurality of actuators traversing through the base.

2. The pedal operated automatic guitar chord player as claimed in claim 1 comprises:
- the actuator assembly further comprises a plurality of chord feedback indicators;
- the plurality of chord feedback indicators being electrically connected to the power supply; and
- the plurality of chord feedback indicators being electronically connected to the microcontroller.

3. The pedal operated automatic guitar chord player as claimed in claim 2 comprises:
- the chord actuator further comprises a chord actuator board;
- the chord actuator board being adjacently connected to the mounting frame opposite the base; and
- the plurality of chord feedback indicators being positioned about the chord actuator board.

4. The pedal operated automatic guitar chord player as claimed in claim 3 comprises:
- the casing comprises a transparent panel; and
- the transparent panel being positioned adjacent to the plurality of chord feedback indicators.

5. The pedal operated automatic guitar chord player as claimed in claim 1 comprises:
- the chord actuator further comprises a guitar strap attachment; and
- the guitar strap attachment being connected to the base opposite the mounting frame.

6. The pedal operated automatic guitar chord player as claimed in claim 1, wherein each of the plurality of actuators is a linear actuator.

7. The pedal operated automatic guitar chord player as claimed in claim 1 comprises:
- each of the plurality of actuators further comprises a servo, a first teeter joiner, and a second teeter joiner;
- the first teeter joiner and the second teeter joiner being pivotally connected to the servo; and
- the first teeter joiner and the second teeter joiner being positioned opposite each other about the servo.

8. The pedal operated automatic guitar chord player as claimed in claim 7 comprises:
- the at least one finger being specifically a first finger and a second finger;
- the first finger being adjacently connected to the first teeter joiner; and
- the second finger being adjacently connected to the second teeter joiner.

9. The pedal operated automatic guitar chord player as claimed in claim 1 comprises:
- the electronic device connection means being an actuator transceiver.

10. The pedal operated automatic guitar chord player as claimed in claim 1 comprises:
- the electronic device connection means being a port; and
- the port traversing through the casing.

11. The pedal operated automatic guitar chord player as claimed in claim 1 comprises:
- the actuator assembly further comprises a portable power source; and
- the portable power source being electrically connected to the power supply.

12. A pedal operated automatic guitar chord player comprises:
- a chord actuator;
- an actuator assembly;
- a pedal;
- the chord actuator comprises a base, a mounting frame, a casing, a first clamp, a second clamp, and a guitar strap attachment;

the actuator assembly comprises a plurality of actuators, a microcontroller, a power supply, and a plurality of chord feedback indicators;

each of the plurality of actuators comprises at least one finger;

the microcontroller comprises an electronic device connection means;

the mounting frame being adjacently connected to the base;

the casing being adjacently attached to the base;

the casing being positioned around the mounting frame;

the first clamp, the second clamp, and the guitar strap attachment being adjacently attached to the base opposite the mounting frame;

the first clamp and the second clamp being positioned opposite each other across the base;

the actuator assembly being positioned within the casing;

the plurality of actuators being adjacently connected to the mounting frame;

the plurality of actuators, the microcontroller, the plurality of chord feedback indicators, and the pedal being electrically connected to the power supply;

the plurality of actuators, the plurality of chord feedback indicators, and the pedal being electronically connected to the microcontroller; and the at least one finger of each of the plurality of actuators traversing through the base.

13. The pedal operated automatic guitar chord player as claimed in claim 12 comprises:

the chord actuator further comprises a chord actuator board;

the chord actuator board being adjacently connected to the mounting frame opposite the base; and the plurality of chord feedback indicators being positioned about the chord actuator board.

14. The pedal operated automatic guitar chord player as claimed in claim 13 comprises:

the casing comprises a transparent panel; and the transparent panel being positioned adjacent to the plurality of chord feedback indicators.

15. The pedal operated automatic guitar chord player as claimed in claim 12, wherein each of the plurality of actuators is a linear actuator.

16. The pedal operated automatic guitar chord player as claimed in claim 12 comprises:

each of the plurality of actuators further comprises a servo, a first teeter joiner, and a second teeter joiner;

the at least one finger being specifically a first finger and a second finger;

the first teeter joiner and the second teeter joiner being pivotally connected to the servo;

the first teeter joiner and the second teeter joiner being positioned opposite each other about the servo;

the first finger being adjacently connected to the first teeter joiner; and the second finger being adjacently connected to the second teeter joiner.

17. The pedal operated automatic guitar chord player as claimed in claim 12 comprises:

the electronic device connection means being an actuator transceiver.

18. The pedal operated automatic guitar chord player as claimed in claim 12 comprises:

the electronic device connection means being a port; and the port traversing through the casing.

19. The pedal operated automatic guitar chord player as claimed in claim 12 comprises:

the actuator assembly further comprises a portable power source; and the portable power source being electrically connected to the power supply.

20. A pedal operated automatic guitar chord player comprises:

a chord actuator;

an actuator assembly;

a pedal;

the chord actuator comprises a base, a mounting frame, a chord actuator board, a casing, a first clamp, a second clamp, and a guitar strap attachment;

the actuator assembly comprises a plurality of actuators, a microcontroller, a power supply, and a plurality of chord feedback indicators;

each of the plurality of actuators comprises a first finger, a second finger, a servo, a first teeter joiner, and a second teeter joiner;

the microcontroller comprises an electronic device connection means;

the mounting frame being adjacently connected to the base;

the chord actuator board being adjacently connected to the mounting frame opposite the base;

the casing being adjacently attached to the base;

the casing being positioned around the mounting frame;

the first clamp, the second clamp, and the guitar strap attachment being adjacently attached to the base opposite the mounting frame;

the first clamp and the second clamp being positioned opposite each other across the base;

the actuator assembly being positioned within the casing;

the servo of each of the plurality of actuators being adjacently connected to the mounting frame;

the plurality of actuators, the microcontroller, the plurality of chord feedback indicators, and the pedal being electrically connected to the power supply;

the plurality of actuators, the plurality of chord feedback indicators, and the pedal being electronically connected to the microcontroller;

the plurality of chord feedback indicators being positioned about the chord actuator board;

the first teeter joiner and the second teeter joiner being pivotally connected to the servo;

the first teeter joiner and the second teeter joiner being positioned opposite each other about the servo;

the first finger being adjacently connected to the first teeter joiner;

the second finger being adjacently connected to the second teeter joiner; and the first finger and the second finger of each of the plurality of actuators traversing through the base.

* * * * *